US005449335A

United States Patent [19]

Steinfeld

[11] Patent Number: 5,449,335

[45] Date of Patent: Sep. 12, 1995

[54] WAIST-TRIMMING EXERCISE APPARATUS

[75] Inventor: Peter Steinfeld, Agoura Hills, Calif.

[73] Assignee: Better Shape-up, Inc., Agoura Hills, Calif.

[21] Appl. No.: 163,117

[22] Filed: Dec. 6, 1993

[51] Int. Cl.[6] ..... A63B 22/14; A63B 23/02

[52] U.S. Cl. ..... 482/110; 482/94; 482/106; 482/108; 482/134; 482/139; 482/142; 482/908

[58] Field of Search ..... 482/k8, 93, 110, 133–136, 482/138–140, 146–148, 142, 134, 109, 908; 273/187 R, 187.2, 188 R, 35 R; 602/36; 434/252, 256; 269/86, 95, 162; 24/490, 495, 498, 499; 414/23; 47/42, 43, 47; 408/238; 248/95, 96, 157, 161, 419, 511

[56] References Cited

U.S. PATENT DOCUMENTS

| | | | |
|---|---|---|---|
| 2,469,301 | 5/1949 | Johnston . | |
| 2,755,091 | 7/1956 | Hara | 273/187.2 |
| 3,109,244 | 11/1963 | Trifaro et al. | 273/35 R |
| 3,215,438 | 11/1965 | Sheldon et al. | 273/188 R |
| 3,698,721 | 10/1972 | Stewart | 273/188 R |
| 3,874,660 | 4/1975 | Brethen | 482/109 |
| 4,402,505 | 9/1983 | Young . | |
| 4,653,750 | 3/1987 | McIntyre . | |
| 4,678,186 | 7/1987 | McIntyre et al. . | |
| 5,050,885 | 9/1991 | Ballard et al. | 273/188 R |
| 5,102,142 | 4/1992 | Bittl . | |
| 5,288,074 | 2/1994 | Scheurer | 273/188 R |

FOREIGN PATENT DOCUMENTS

| | | | |
|---|---|---|---|
| 0076054 | of 1893 | Germany | 482/133 |

*Primary Examiner*—Richard J. Apley
*Assistant Examiner*—Victor K. Hwang
*Attorney, Agent, or Firm*—Poms, Smith, Lande & Rose

[57] ABSTRACT

A system for exercising a user's midsection muscles. The system includes a spotting fixture having a base, side frame members and a central vertical member arranged in a tripod configuration. C-shape arms are supported atop the side frame members and central vertical member. The C-shape arms partially wrap around the user who stands on the base. At each end of the C-shape arms are swivel mounted mechanical hands that engage the hip or waist area of the user, thus holding the user's lower body immobile during the exercise routine. The mechanical hands adjust laterally into and out of slots formed in the C-shape arms as well as adjust vertically with telescoping lateral frame members. Free weights such as a twisting baton can be held by the user to increase the exertion level during the exercise regime. A receptacle located in the base allows storage of the free weight or twisting baton.

13 Claims, 1 Drawing Sheet

FIG. 1
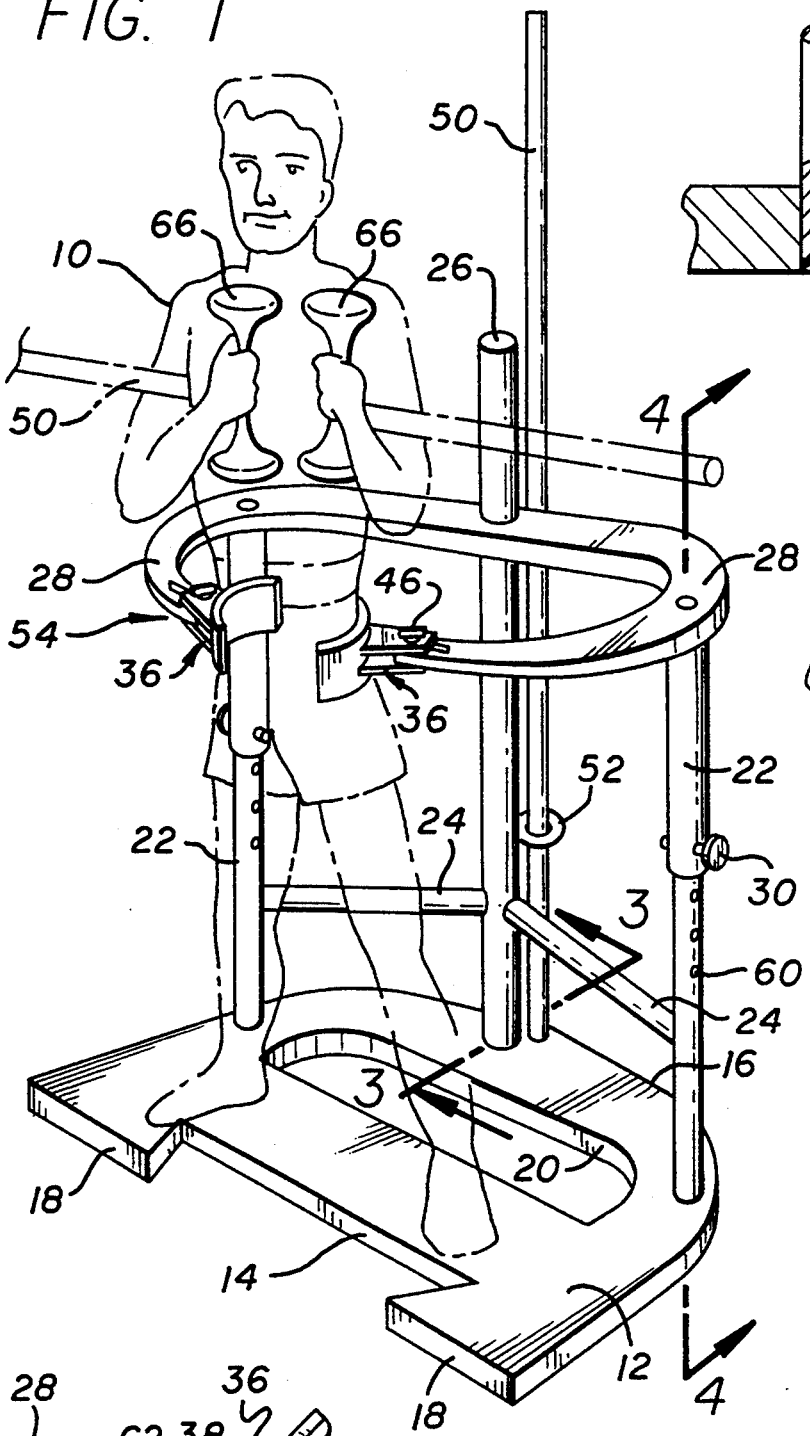
FIG. 3
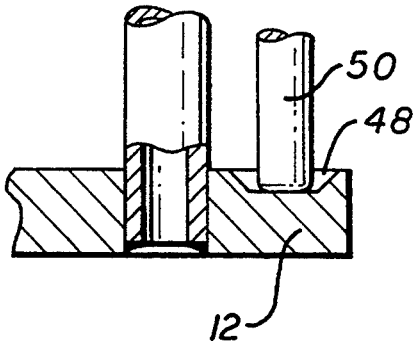
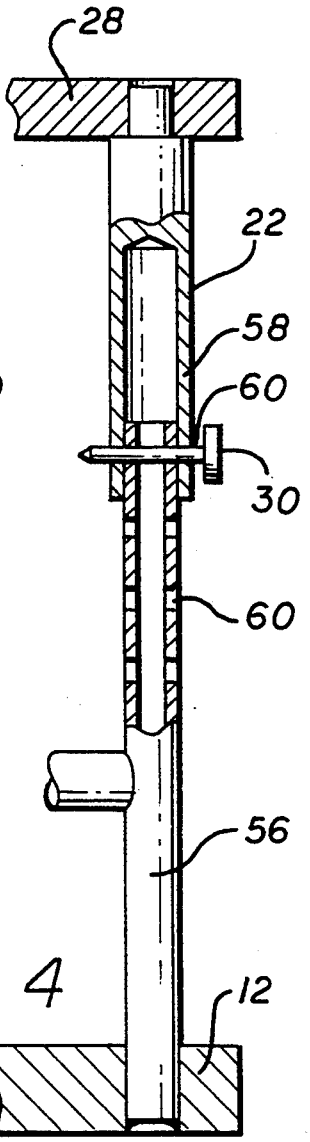
FIG. 4
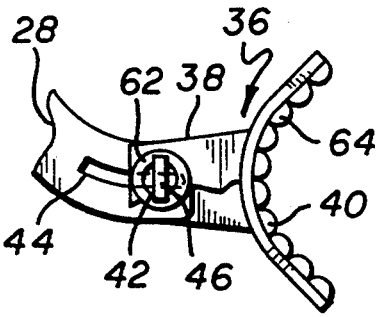
FIG. 2

WAIST-TRIMMING EXERCISE APPARATUS

BACKGROUND OF THE INVENTION

1. Field of the Invention

The present invention relates to exercise equipment. More precisely, the present invention relates to an exercise system incorporating a spotting fixture and a free weight or exercise baton.

2. Prior Art and Related Information

Exercise equipment dedicated to all varieties of purposes have become very popular as health and fitness have become more important to our lives. What started with dumbbells and free weights have evolved into suspended weights, and what are commonly referred to as UNIVERSAL GYMS. Complicated machines were developed to work specific muscle groups. For example, one type of apparatus simulates cross-country skiing, thus giving a low impact aerobic exercise without requiring the user to leave the comforts of home. Another exercise machine known as a NAUTILUS machine uses variable resistance applied at different stages of each rep of the exercise.

Most exercise equipment are tailored to work on a specific muscle group; e.g., those located in an individual's midsection. For instance, one common suspended weight system permits a user to perform stomach crunches. In such an exercise regime, the user is seated and his or her legs are hooked in an immobile position; the upper torso displaces weight resistance toward his knees as he pivots at the waist. This type of stomach crunch exercise is beneficial for building firm abdominal muscles as well as strengthening lower back muscles. Of course, a simple sit-up bench where the feet hook under horizontal posts is well-known in the art for strengthening abdominal muscles.

Another frequently seen exercise apparatus for building external oblique muscles in the midsection also relies on suspended weights. In such a machine, the user is seated while the upper torso rotates left and right. The rotational motion of the upper torso pushes against weight resistance, which motion lifts the suspended weights. This machine, as in most conventional suspended weight machines, uses cable and pulley mechanisms to transfer weight into mechanical resistance.

There are also other attempts at exercising the abdominal muscles as well as the external oblique muscles in the midriff. One design is a simple bowl-shaped seat in which the user sits. The bowl shape assists the user in doing sit-ups by helping him rock forward during the lifting part of the sit-up.

Another device for working out midsection fat, of questionable efficacy however, is the motorized belt. The belt wraps around a user's waist and is driven by a motor to reciprocate back and forth around the waist. The reciprocating belt purportedly exercises the midsection thereby removing fat.

Nothing in the art is simply constructed, easy to use, or can function as an inanimate spotter. Hence, a need presently exists for a midsection exercise apparatus.

The present invention is well suited for trimming the waist, providing a platform for other midsection workouts, and functioning as a spotter. The present invention is also simple in construction, yet highly innovative.

SUMMARY OF THE INVENTION

The present invention is directed to a system for exercising a user's midsection muscles. Generally, the system comprises a spotting fixture that holds the user's hips immobile, while he holds a wooden baton, or one or more free weights in his hands and rotates his upper torso. The spotting fixture preferably has a base on which the user stands during the exercise regimen. The base has feet extending out the front for stability and includes a receptacle for storing the wooden baton or free weights when not in use.

Preferably three frame members extend vertically from the base and are arranged in a tripod fashion. The frame members are disposed offset toward the back of the base for proper balance and partially circumscribe the user. At the top of the three frame members is a horizontally disposed C-shape brace, having two opposed ends. The opening of the C-shape is where the user stands during the exercise program. Two mechanical hands are adjustably attached to the opposed ends of the C-shape brace, and support the user at the hips during the exercises.

The present invention easily adjusts to match the physique of the user. First, the mechanical hands slide laterally along slots in the C-shape brace to adjust to the user's hip or waist size. Second, each mechanical hand has a curved palm portion that comfortably cradles the curvature of the user's hip or waist. Third, the three frame members preferably include coaxial submembers that telescope for height adjustment tailored to match the height of the user. Fourth, each mechanical hand swivels on an axis so as to give another level of adjustment. After the adjustment is made, an optional mechanical locking mechanism immobilizes the mechanical hand.

The swiveling mechanical hands conveniently permits the user to mount and dismount. That is, the mechanical hands swivel out of the way when the user dismounts from the spotting apparatus.

In use, the spotting fixture firmly holds the user within the grasp of the two mechanical hands while he stands erect on the base. In this manner, the user can rotate his upper torso while the present invention firmly holds his hips and legs in place, preventing rotation thereof.

Optionally, the user may hold a baton or one or more free weights in his hands to provide more momentum during his upper torso rotations. As the user begins his upper torso rotation using the baton, or weights, such as dumbbells, midway through the exercise stroke he can stop his motion and resist the momentum generated by the moving free weights. This exercise builds the external oblique muscles, thereby eliminating what are commonly referred to as "love handles." Likewise, the abdominal muscles are strengthened by resisting the upper trunk rotation caused by the inertia of the moving free weights.

The present invention is adaptable to other exercises. For example, the spotting fixture can be used for routines that require bending at the waist in either the forward or lateral directions. Such exercises strengthen the external oblique muscles, the abdominal muscles, as well as the lower back muscles. In the same vein, the same motions used in conjunction with the present invention can be a means for stretching those various muscle groups.

Therefore, in view of the foregoing, it is an object of the present invention to provide a spotting fixture that braces a user at his waist or hips during an exercise routine. It is another object of the present invention to provide a free weight for use in conjunction with the spotting fixture. It is still another object of the present invention to provide a spotting fixture that easily adjusts to the hip or waist size and height of various users. It is yet another object of the present invention to provide a solid platform from which a user may perform many exercises.

BRIEF DESCRIPTION OF THE DRAWINGS

FIG. 1 provides a perspective view of a preferred embodiment of the present invention.

FIG. 2 provides an enlarged plan view of a preferred embodiment of the mechanical hand showing its connection to the C-shape arm portion.

FIG. 3 is a partial sectional view of the central vertical member forming one leg of the tripod.

FIG. 4 is a sectional view of a preferred embodiment of the telescoping frame member.

DETAILED DESCRIPTION OF THE INVENTION

In the following description, numerous details such as specific materials and configurations are set forth in order to provide a more complete understanding of the present invention. But, it is understood by those skilled in the art that the present invention can be practiced without those specific details. In other instances, well-known elements are not described explicitly so as not to obscure the present invention.

FIG. 1 provides a perspective view of a preferred embodiment of the present invention exercise system. The exercise system includes a spotting fixture 54 and an optional free weight, or a baton 50 shown here. As seen in FIG. 1, the spotting fixture 54 holds the waist or hips of a user 10 immobile while he performs upper torso rotations. To increase the workout effort, the user 10 may incorporate the baton 50 or other free weights into his exercise routine.

Although the present description addresses only upper torso rotations, it is clear that the present invention is easily adaptable to numerous other exercises known in the art. For instance, the user may prop himself off the ground on the spotting fixture and perform leg lifts.

Returning to FIG. 1, the user 10 stands on the base 12 of the spotting fixture 54. The base 12 is preferably weighted to provide a solid anchoring platform for performing exercises. On the front 14 of the base 12 are two outstretched feet 18. The feet 18 improve the stability of the base 12. A cut-out 20 can be used for a specific design purpose or merely to save material in the base 12.

Extending vertically from the opposite sides of the base 12 are preferably two side frame members 22. Between the side frame members 22 is a central vertical member 26. In the preferred embodiment shown in FIG. 1, the side frame members 22 and the central vertical member 26 are arranged in a tripod configuration for greater torsional and bending rigidity. Cross members 24 further improve the rigidity of the overall superstructure. For an extra measure of strength and stability, the central vertical member 26 and side frame members 22 plug into receiving holes inside the base 12. The parts may be joined by welding.

All together, the side frame members 22 and central vertical member 26 form a tripod that supports C-shape arms 28. In the preferred embodiment, the two C-shape arms 28 are joined and are one-piece as shown. Naturally, the C-shape arms 28 can be fabricated from multiple pieces which may provide a greater degree of adjustment for the user 10. The C-shape arms 28, which are attached to mechanical hands described below, are intended to engage the waist or hips of the user 10 during his or her exercise regime.

To ensure that the C-shape arms 28 are positioned hip- or waist-high based on the height of the user 10, the vertical height of the C-shape arms 28 can be adjusted. To facilitate this vertical adjustment, each side frame member 22 includes at least two coaxially disposed tubes that telescope. FIG. 4 provides a cross-sectional view of one side frame member 22, taken along line 4—4. In order to enable the telescoping action, each side frame member 22 comprises an inner tube that is coaxially disposed inside an outer tube 58. Only two telescoping stages are shown here, but more stages can be used if needed. A spring loaded pin 30 passing through the outer tube 58 aligns with one of several holes 60 disposed in the inner tube 56 to interconnect the two tubes. This mechanism provides a positive interlock between the telescoping tubes 56, 58.

The majority of the superstructure of the spotting fixture 54 including the side frame members 22, central vertical member 26, and C-shape arms 28 are all located toward the back 16 of the base 12 to counter the weight of the user 10 standing near the front 14. Also, the forward extending feet 18, mentioned earlier, prevent the spotting fixture 54 from becoming unbalanced and tipping forward.

Also noteworthy in FIG. 4 is that the ends of the side frame members 22 fit into receiving holes in the base 12 and the C-shape arms 28. As mentioned earlier, this kind of positive engagement ensures that the spotting fixture 54 is stable and solid. Lastly, although FIG. 4 shows round tubing 56, 58, tubing of other geometric shapes such as squares and triangles can be used.

As best seen in FIG. 1, the C-shape arms 28 freely slide up and down the central vertical member 26. So as the height of the outer tube 58 is changed, and the C-shape arms 28 are moved therealong, the latter is free to slide up and down the central vertical member 26. An optional friction lock (not shown) may be added to lock the C-shape arms 28 to the central vertical member 26.

In order to function as a brace and spotter, the present invention spotting apparatus 54 uses the C-shape arms 28 to locate two mechanical hands 36 on the user's hip or waist area. As seen in the detail plan view of FIG. 2, each mechanical hand 36 comprises a wrist 38 that gradually transitions into counteracting thumb and finger formations, resulting in a palm 40. Each palm 40 is shaped to comfortably and securely engage the user's hip or waist area. Overall, the effect is equivalent to having a human spotter bracing the user at the hips or waist with both hands. The wrist 38 attaches to the C-shape arms 28 as shown.

The present invention has several features to adjust the mechanical hands 36 to match the hip or waist proportions of the user 10. First, the mechanical hands 36 adjust vertically by moving the C-shape arms 28 up and down.

Second, the mechanical hands 36 swivel about a vertical axis. In particular, in an exemplary embodiment, the wrist 38 of the mechanical hand 36 includes a swivel 42. The swivel 42 slides into a slot 44 formed into the open end of each C-shape arm 28. Thus, the mechanical hand 36 can rotate in or out toward or away from the user's body.

Third, the swivel 42 disposed in the wrist 38 can slide along the slot 44 thereby allowing the mechanical hand 36 to adjust laterally to suit the user's hip or waist size. An optional wing nut 46 engaging a threaded end of the swivel 42 allows the user 10 to screw down the wrist 38 to clamp it against the C-shape arm 28. With the wrist 38 clamped, the mechanical hand 36 cannot rotate and is secure for any exercise routine. Afterward, the user 10 unscrews the wing nuts 46 to release the user 10 from the grasp of the mechanical hands 36. Of course, other mechanical friction locks known in the art can be used aside from the wing nut.

In addition, the mechanical hands 36 can be optionally spring loaded with a torsion or like spring 62 known in the art. When the spring is assembled coaxially with the swivel 42, for example, and is latched to the mechanical hand 36, it is possible to bias the rotation of the mechanical hand 36 about the swivel 42 in one of two angular directions. That is, the mechanical hands 36 can be predisposed to have both palms 40 face outward, wherein the user 10 would push against a bias in order to rotate both mechanical hands 36 inward. Conversely, it is possible to bias the mechanical hands 36 inward so that both palms 40 are opposite each other. The user 10 would meet with resistance when attempting to rotate both mechanical hands 36 outward to release himself from the exercise system. Numerous other spring or linkage combinations known in the art can be used, too.

According to FIG. 3, which is a sectional view taken along line 3—3 of FIG. 1, the present invention system preferably includes a receptacle 48 located in the base 12 to secure a baton 50 or other free weight or dumpbells 66 when not in use. The baton 50 passes through a guide ring 52 attached to the central vertical member 26 and slides into the receptacle 48, thus holding the baton 50 to the base 12 and central vertical member 26.

The present invention system can be used without the baton 50. For instance, the user 10 with the mechanical hands 36 holding his lower body immobile can perform a number of upper torso exercise to stretch and strengthen various muscle groups. The baton 50 can be held by the user 10 to produce more rotational momentum if needed for a more demanding workout. Aside from the baton 50, the present invention system can be used in combination with dumbbells, barbells, and other free weights known in the art. It should be noted that the user 10 can face the back 16 while braced by the spotting fixture 54, or he or she can use the spotting fixture 54 while facing the front 14 as well.

In a preferred embodiment, the base 12 is fabricated from cast aluminum. The telescoping frame members 22 are made from tubular steel. The C-shape arms 28 are molded from cast aluminum or an alloy equivalent. In an exemplary embodiment, the mechanical hands are constructed of fabricated sheet metal and optionally covered with a padded vinyl surface 64 or the like as seen in FIG. 2.

I claim:

1. An exercise system comprising:

a spotting fixture including

C-shape arm portions having a first end opposed to a second end;

two mechanical hands engaging the first and second opposed ends; and a base supporting the C-shape arm portions at a given height wherein the base includes at least three frame members supporting the C-shape arm portions of which at least two of the frame members include sub-members aligned coaxially to telescope with respect to each other;

whereby the two mechanical hands are adapted to grasp and immobilize a user at his hip area during an exercise regimen while the user stands on the base.

2. The system defined in claim 1, wherein the system further comprises a weighted member which is removably stored on the spotting fixture when not in use, and each mechanical hand includes a swivel.

3. The system defined in claim 2, wherein the spotting fixture further comprises a receptacle for receiving the weighted member.

4. The system defined in claim 3, wherein the weighted member includes a baton.

5. The system defined in claim 4, wherein each mechanical hand further comprises a biasing member which biases each mechanical hand in an angular direction about the swivel.

6. The system defined in claim 5, wherein the mechanical hands include padding.

7. The system defined in claim 6, wherein the frame members comprise tubular steel.

8. The system defined in claim 2, wherein each swivel further comprises a locking mechanism to clamp the mechanical hand to its respective opposed end of the c-shape arm portions.

9. The system defined in claim 1, wherein the at least three frame members comprises a central vertical member flanked by two side frame members, and wherein the central vertical member is longer than each of the two side frame members.

10. The system defined in claim 1, wherein the base includes a cut-out portion and two outwardly extending feet located at a front of the base.

11. The system defined in claim 1, wherein each mechanical hand further comprises a curved palm.

12. A system for exercising a user's hip area during an exercise regimen comprising:

a free weight adapted to be held by the user;

a base on which the user stands having a front and back, and having feet extending from the front of the base, and including a receptacle to hold the free weight when not in use;

three frame members extending vertically from the base, arranged in a tripod fashion, and disposed offset toward the back of the base, and wherein at least two of the three frame members include sub-members aligned coaxialy to telescope with respect to each other;

a C-shape brace adapted to be partially circumscribe the user, supported on the at least two of the three frame members and having two opposed ends, wherein each opposed end includes a slot;

two mechanical hands, each having a wrist portion and a curved palm portion;

a swivel disposed in the wrist portion, hingeably attaching the mechanical hand to the slot of the respective opposed end;

whereby the two mechanical hands swivel relative to the C-brace and slide along the respective slots to adjust to the user's hip area and to brace and immobilize the hip area.

13. The system defined in claim 12, wherein the swivel further comprises a spring biasing the mechanical hand about the swivel.

* * * * *